US011529534B2

(12) United States Patent
Bodemann et al.

(10) Patent No.: US 11,529,534 B2
(45) Date of Patent: Dec. 20, 2022

(54) WET PIPE FIRE PROTECTION SPRINKLER SYSTEM DUAL AIR VENT WITH VENT FAILURE FAILSAFE FEATURE

(71) Applicant: South-Tek Systems, LLC, Wilmington, NC (US)

(72) Inventors: Scott Christian Bodemann, Wilmington, NC (US); Robert Alan Norman, Leland, NC (US)

(73) Assignee: SOUTH-TEK SYSTEMS, LLC, Wilmington, NC (US)

( * ) Notice: Subject to any disclaimer, the term of this patent is extended or adjusted under 35 U.S.C. 154(b) by 40 days.

(21) Appl. No.: 16/148,716

(22) Filed: Oct. 1, 2018

(65) Prior Publication Data

US 2020/0101336 A1 Apr. 2, 2020

(51) Int. Cl.
*A62C 35/60* (2006.01)
*A62C 31/00* (2006.01)

(52) U.S. Cl.
CPC ..... *A62C 35/60* (2013.01); *A62C 31/005* (2013.01)

(58) Field of Classification Search
CPC ..... A62C 35/60; A62C 35/68; A62C 35/58; A62C 31/005; A62C 35/62; Y10T 137/3099; A72C 37/04
USPC ..... 239/125–127
See application file for complete search history.

(56) References Cited

U.S. PATENT DOCUMENTS 2,865,674 A * 12/1958 Jelmeland ..... A62C 35/605 52/16
6,926,023 B2 * 8/2005 Cabral ..... F17D 5/02 137/2
2010/0263882 A1 * 10/2010 Bodemann ..... F16K 15/04 169/17
2011/0108123 A1 * 5/2011 Burkhart ..... A62C 35/60 137/197
2011/0226495 A1 * 9/2011 Burkhart ..... A62C 35/60 137/589
2013/0341055 A1 * 12/2013 Kochelek ..... A62C 37/04 169/46
2015/0021052 A1 * 1/2015 Kochelek ..... A62C 35/68 169/16
2017/0100617 A1 * 4/2017 Kochelek ..... A62C 37/50

* cited by examiner

*Primary Examiner* — Christopher R Dandridge
(74) *Attorney, Agent, or Firm* — Coats & Bennett, PLLC

(57) ABSTRACT

A dual air vent assembly for wet pipe fire protection sprinkler systems allows air or gas to vent from system pipes as they fill, without spilling any water into the fire-protected environment, even if an air vent valve, operative to discharge air or gas but not fluid, fails. A shut-off valve is upstream of the first air vent valve, and a reservoir is downstream of it. Small amounts of water that escape the first air vent valve are collected in the downstream reservoir, and evaporate. The reservoir also collects fluid if the first air vent valve fails. In response to fluid in the reservoir at or above a predetermined level, the shut-off valve is actuated to arrest the flow of fluid into the first air vent valve. No water escapes the assembly, even if the first air vent valve fails. The shut-off valve may be electronically or mechanically actuated.

20 Claims, 5 Drawing Sheets

WET PIPE FIRE PROTECTION SPRINKLER SYSTEM DUAL AIR VENT WITH VENT FAILURE FAILSAFE FEATURE

FIELD OF INVENTION

The present invention relates generally to fire protection sprinkler systems, and in particular to a dual air vent for wet pipe systems, having a failsafe shut-off that will not discharge water even in the event of a failure of a water-blocking primary air vent.

BACKGROUND

Fire sprinkler systems are a well-known type of active fire suppression system. Sprinklers are installed in all types of buildings, commercial and residential, and are generally required by fire and building codes for buildings open to the public. Typical sprinkler systems comprise a network of pipes, usually located at ceiling level, that are connected to a reliable water source. Sprinkler heads are disposed along the pipes at regular intervals. Each sprinkler head includes a fusible element, such as a frangible glass bulb, that is heat-sensitive and designed to fail at a predetermined temperature. Failure of the fusible element or glass bulb opens an orifice, allowing water to flow through the head, where it is directed by a deflector into a predetermined spray pattern. Sprinkler systems may suppress a fire, or inhibit its growth, thereby saving lives and limiting inventory loss and structural damage. Sprinkler specifications are published by the National Fire Protection Association (e.g., NFPA 13).

The fire protection sprinkler system is fed from a pump room or riser room. In a large building the fire protection sprinkler system consist of several "zones," each being fed from a separate riser in the pump room (i.e., a "zone" refers to the piping network tied to one particular riser). The riser contains the main isolation valve and other monitoring equipment (e.g., flow switches, alarm sensors, and the like). The riser is typically a 2, 3, 4, 6, or 8 inch diameter pipe coupled to the building's main water supply. In some cases, the water supply pressure may be increased with a booster pump (called the fire pump). The riser then progressively branches off into smaller branch lines. At the furthest point from the riser, typically at the end of each zone, there is an "inspector's test port," which is used for flow testing.

The most basic fire protection sprinkler system is a "wet pipe" system, wherein the sprinkler pipes are full of water under a predetermined "internal set point" pressure. If the water pressure decreases below the set point, valves are opened and the pump (if applicable) is activated, and water flows into the sprinkler pipes in an attempt to maintain the pressure. The set point pressure drops when water escapes the system, such as due to the opening of a sprinkler head in the event of a fire.

The pipes of a sprinkler system are periodically drained, and the piping network is inspected. Parts may be replaced, e.g., where signs of corrosion are observed, to install new functionality, or simply as part of a periodic replacement program. When the system is again filled with water, vents must be opened to allow air or other gas displaced by the water to exit (per 2016 NFPA 13 guidelines). These air vents are installed at high points in the piping network, and include a mechanism, such as a poppet or ball valve, which ideally allows air to escape but blocks the flow of water out of the vent. In practice, some small amount of is water often discharged from the air vent before the water blocking mechanism can fully shut off the water flow. This spillage is at best a nuisance, and may present a hazard if the water were to fall onto, e.g., shopping center floors, computers other electronic equipment, inventory, etc. Furthermore, the air vent valves deployed in wet pipe sprinkler systems to pass air or gas but prevent the discharge of water, are known to fail, resulting in significant leaking, or even flooding if not detected and arrested. In general, it would be advantageous for the fire-protected environment (building, home, factory, parking garage, or the like) to be completely free from water discharge by a wet pipe fire protection sprinkler system, even in the event of a component failure.

The Background section of this document is provided to place embodiments of the present invention in technological and operational context, to assist those of skill in the art in understanding their scope and utility. Approaches descried in the Background section could be pursued, but are not necessarily approaches that have been previously conceived or pursued. Unless explicitly identified as such, no statement herein is admitted to be prior art merely by its inclusion in the Background section.

SUMMARY

The following presents a simplified summary of the disclosure in order to provide a basic understanding to those of skill in the art. This summary is not an extensive overview of the disclosure and is not intended to identify key/critical elements of embodiments of the invention or to delineate the scope of the invention. The sole purpose of this summary is to present some concepts disclosed herein in a simplified form as a prelude to the more detailed description that is presented later.

According to one or more embodiments described and claimed herein, a dual air vent assembly for a wet pipe fire protection sprinkler system allows air or gas to vent from the system pipes as they fill with water, without spilling any water into the fire-protected environment. The dual air vent assembly features a shut-off valve upstream of a first air vent valve, and a reservoir having a fluid level sensor downstream of the first air vent valve. The first air vent valve nominally vents air or gas but not water. The reservoir collects any small amount of water that passes through the first air vent valve as it triggers; this water evaporates. The reservoir also collects larger amounts of water in the event the first air vent valve fails. A fluid level sensor outputs a signal if the water level in the reservoir is at or above a predetermined level. Control electronics close the upstream shut-off valve, in response to the fluid level sensor output signal, to arrest the flow of water to the first air vent valve. Hence no water is discharged into the fire-protected environment, either during filling of the system with water, or in the event of a failure of the first air vent valve. Even in the face of a first air vent valve failure, the system remains operative to protect the environment from fire hazard.

One embodiment relates to a dual air vent assembly with a failsafe feature operative to vent air or gas, but not fluid, from a wet pipe fire protection sprinkler system. The dual air vent assembly includes a first air vent valve connected to a pipe of the sprinkler system. The first air vent valve includes a fluid blocking mechanism operative to vent air or gas but substantially no fluid from the pipe to an output. The dual air vent assembly also includes a shut-off valve interposed between the pipe and the first air vent valve. The shut-off valve is operative to arrest a flow of fluid from the pipe to the first air vent valve when actuated. The dual air vent assembly further includes a reservoir including a second air vent, connected in fluid flow relationship to the output of the first air vent valve. Air or gas, and any fluid discharged by the first air vent valve, enter the reservoir; the air or gas is discharged from the reservoir through the second air vent. A fluid level sensor within the reservoir is operative to sense fluid at or above a predetermined level. The shut-off valve is actuated, so as to arrest the flow of fluid from the pipe to the first air vent valve, in response to fluid in the reservoir at or above a predetermined level.

Another embodiment relates to a method of operating a wet pipe fire protection system including at least one dual air vent assembly comprising a first air vent valve connected to a pipe of the sprinkler system and operative to vent air or gas but substantially no fluid from the pipe, a shut-off valve interposed between the pipe and the first air vent valve, a reservoir including a second air vent connected to an output of the first air vent valve in fluid flow relationship, and a fluid level sensor in the reservoir operative to sense fluid at or above a predetermined level. A pipe of the wet pipe fire protection system is filled with fluid. Air or gas, displaced by the fluid, is vented from the pipe via the first air vent valve, reservoir, and second air vent. Any fluid discharged by the first air vent valve as the pipe completely fills with fluid, or in the event of a failure of the first air vent valve, is retained in the reservoir. In response to fluid in the reservoir at or above a predetermined level, the flow of fluid to the first air vent valve is arrested by actuating the shut-off valve.

BRIEF DESCRIPTION OF THE DRAWINGS

The present invention will now be described more fully hereinafter with reference to the accompanying drawings, in which embodiments of the invention are shown. However, this invention should not be construed as limited to the embodiments set forth herein. Rather, these embodiments are provided so that this disclosure will be thorough and complete, and will fully convey the scope of the invention to those skilled in the art. Like numbers refer to like elements throughout.

DETAILED DESCRIPTION

For simplicity and illustrative purposes, the present invention is described by referring mainly to an exemplary embodiment thereof. In the following description, numerous specific details are set forth in order to provide a thorough understanding of the present invention. However, it will be readily apparent to one of ordinary skill in the art that the present invention may be practiced without limitation to these specific details. In this description, well known methods and structures have not been described in detail so as not to unnecessarily obscure the present invention.

Figure 1:
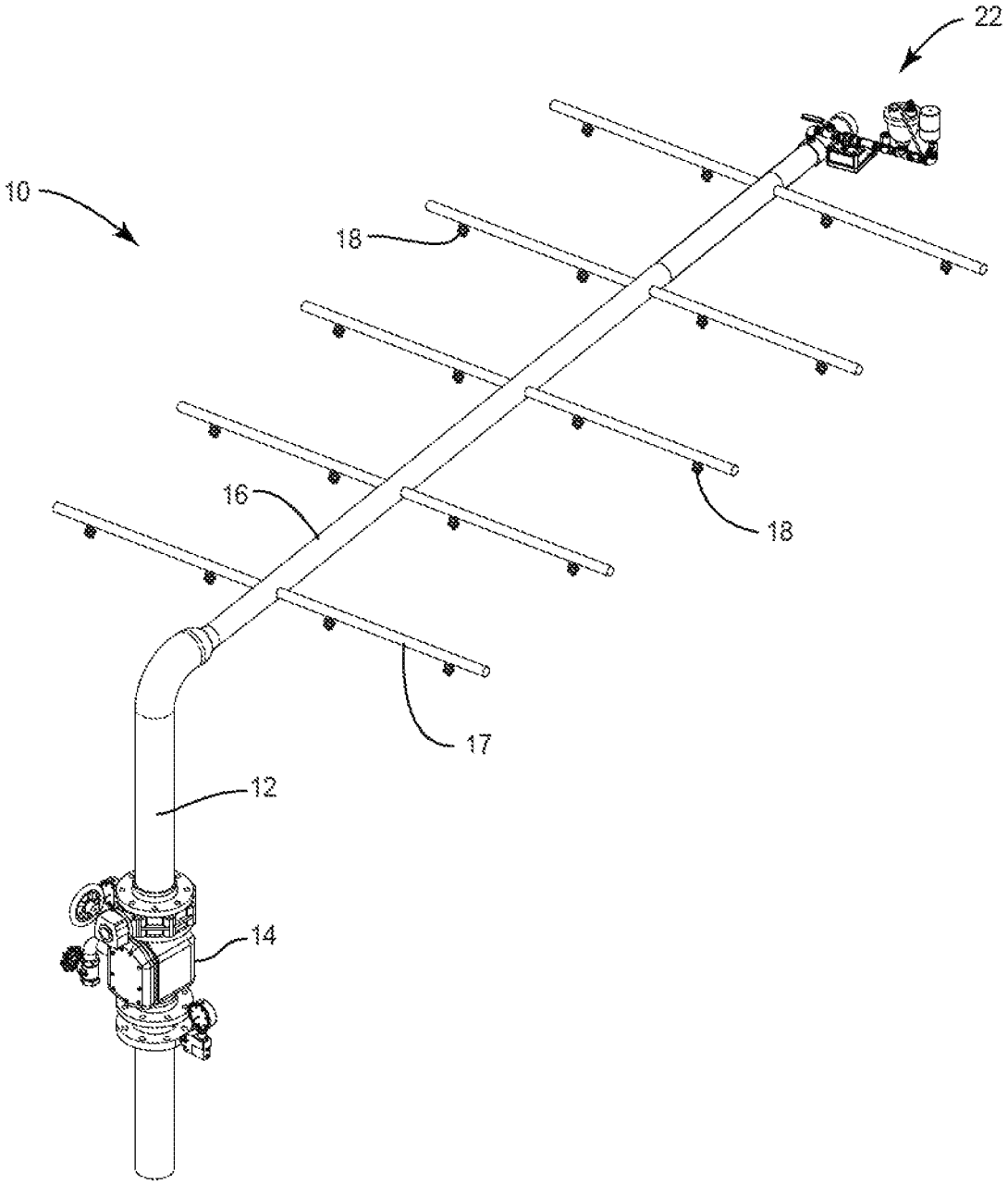
FIG. 1 is a perspective view of one section of a wet pipe fire protection sprinkler system.

FIG. 1 depicts a representative wet pipe fire protection sprinkler system 10, according to one embodiment of the present invention. Water from a reliable source, such as a city main, a water tank, or the like enters a building or other fire-protected environment in a riser 12. A pump or valve 14 controls the flow of water into the fire protection sprinkler system 10, and once full, maintains the water under pressure. A pipe 16 for a particular zone of the fire-protected environment branches off from the riser 12. Smaller cross-pipes 17 branch from the zone pipe 16 at generally regular intervals, and generally cover the environment to be protected. Sprinkler heads 18 are disposed at generally regular intervals along the cross-pipes 17. In any given application, numerous risers 12, and multiple branch lines 16 per riser, may be present and distributed throughout the fire-protected environment.

Branch lines 16 should not be installed perfectly horizontally, but rather to have a defined slope toward one or more drains (not shown). At one or more high points in each branch line 16 a dual air vent assembly 22 allows air, or other gas such as nitrogen, in the pipes 16 to escape, while completely preventing any spillage of water, even in the event of a component failure. As explained more fully herein, the dual air vent assembly 22 comprises reservoir 50 operative to retain small volumes of fluid, and a shut-off valve 40 operative to arrest the flow of water from the pipe 16 if a primary air vent valves fails (which failure would otherwise result in the discharge of water from the wet pipe fire protection sprinkler system 10).

Figure 2:
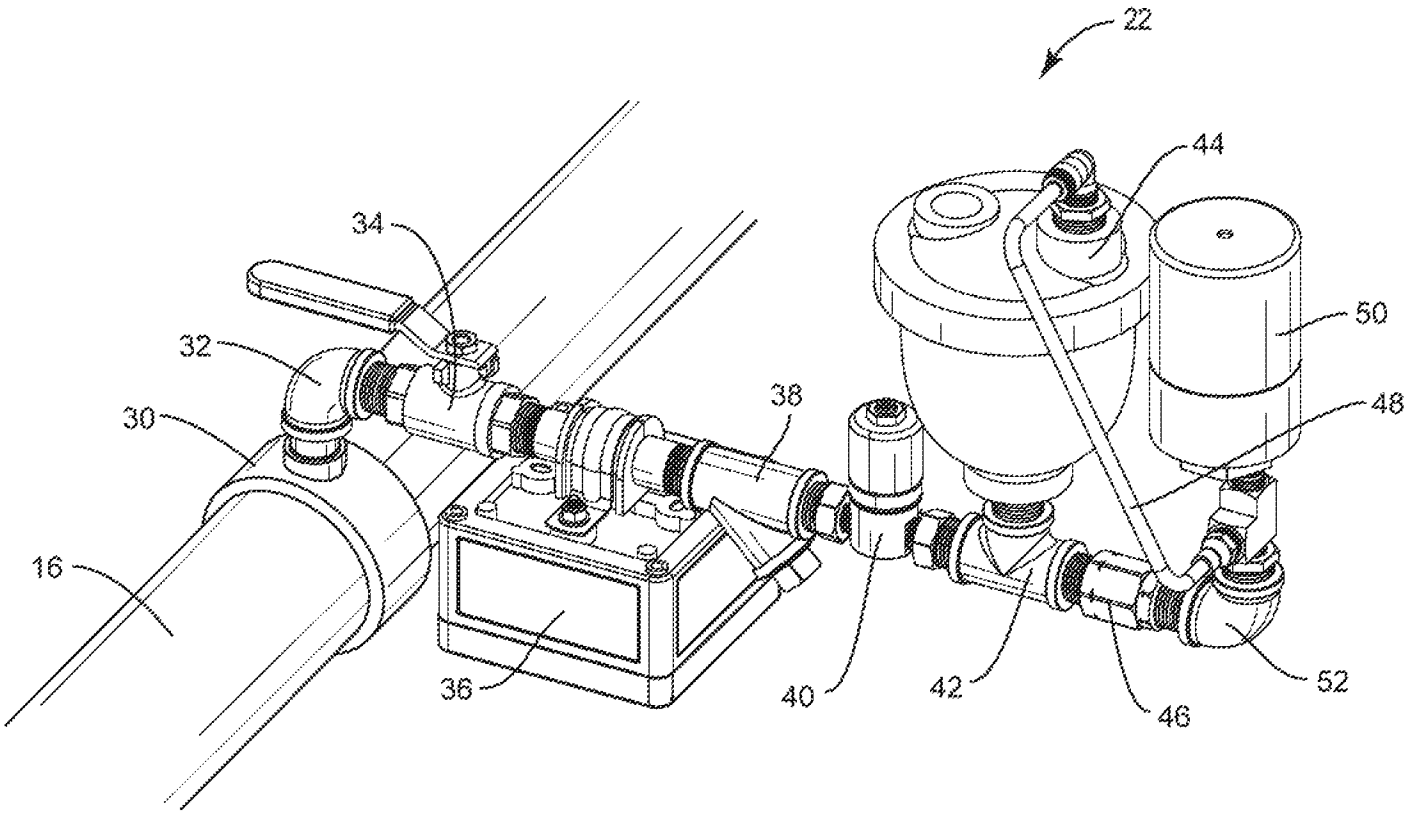
FIG. 2 is a perspective view of a dual air vent having a failsafe shut-off feature.

FIG. 2 depicts a dual air vent assembly 22 having a failsafe shut-off feature, according to one embodiment. The dual air vent assembly 22 attaches to the upper side of a pipe 16, such as by a ½ inch NPT outlet coupling, and is held in place with a collar 30. This embodiment of the dual air vent assembly 22 includes a first elbow fitting 32, a manual valve 34, a control electronics enclosure 36, a filter trap 38, a shut-off valve 40, a "T" connection 42, a first air vent valve 44, a one-way valve 46, a fluid connector 48, a reservoir 50, and a second elbow fitting 52.

As the pipes 12, 16, 17 of the wet pipe fire protection sprinkler system 10 are initially filled with water, air or other gas (such as nitrogen) displaced by the water exits the pipe 16 into the dual air vent assembly 22. The air or gas passes through the first elbow fitting 32, the manual valve 34, the filter trap 38, the shut-off valve 40, and into the first air vent valve 44 via the "T" connection 42. The manual valve 34 is operative to shut off air/gas or water flow from the pipe 16 to the first air vent valve 44. The filter trap 64 is a "Y" connection which includes a screen or other filter element to catch any debris which may otherwise interfere with operation of the dual air vent assembly 22. The screen may be removed, without disassembling the dual air vent assembly 22, to clean or replace the screen or filter element.

The first air vent valve 44 includes a water blocking mechanism that allows air or gas to pass, but largely blocks the flow of water. This could, for example, comprise a membrane, a poppet valve, a ball that seats against a pliant seal when moved by water, or the like. Such mechanisms are well known in the art. The air or gas exits a discharge port of the first air vent valve 44. Those of skill in the art will appreciate that the precise configuration of the air vent valve assembly 22 is representative only, and may vary in different installations.

As the pipes 12, 16, 17 of the wet pipe fire protection sprinkler system 10 fill with water, and substantially all of the air or other gas in the pipe 16 has exited, water will follow the air or other gas into the dual air vent assembly 22. The water flow will be terminated by the water blocking mechanism in the first air vent valve 44, such as a poppet or ball valve. However, in practice, a small amount of water is likely to be discharged from the output of the first air vent valve 44, before the water blocking mechanism has fully engaged. Although not usually voluminous, this water discharge may damage ceiling tiles, equipment, inventory, or the like, or may create a slip-and-fall hazard on some types of flooring, particularly where water is not expected to be encountered.

To prevent even this small amount of water from being discharged, the output of the first air vent valve 44 is connected, via a fluid connector 48, to a reservoir 50. The reservoir 50 includes a second air vent, which discharges the air or gas displaced by water as the pipes 12, 16, 17 are filled. The reservoir 50 is of sufficient volume to collect and retain the small amount of water inadvertently discharged by the first air vent valve 44. This water will normally evaporate over time, with the water vapor exiting the reservoir 50 through the second air vent.

The reservoir 50 is also connected to the pipe 16, via the second elbow fitting 52 and one-way valve 46. The one-way valve 46, such as for example a check valve, is interposed between the first air vent valve 44 and the reservoir 50. When water initially enters the dual air vent assembly 22, it is stopped by the one-way valve 46 and diverted, through the "T" fitting, into the first air vent valve 44. As with many such valves, the one-way valve 46 may initially allow a small amount of water to pass, before its check mechanism (e.g., a rubber ball seating against a flange) fully engages. This small amount of water is simply collected in the reservoir 50, and hence is not discharged from the dual air vent assembly 22 into the fire-protected environment.

When the wet pipe fire protection sprinkler system 10 is drained, such as for inspection, repair, parts replacement, after testing, or the like, any water collected in the reservoir 50 drains through the one-way valve 46, and back into the pipe 16. Hence, during normal operation, the dual air vent assembly 22 allows air or gas displaced by water to exit the pipe 16 as the wet pipe fire protection sprinkler system 10 is filled, but prevents any water from being discharged into the building environment, including even the small amounts of water commonly discharged as the first air vent valve 44 and/or one-way valve 46 initially actuate.

However, air vent valves are known to fail. If the first air vent valve 44 were to fail, unrestricted amounts of water would flow through the connector 48, into the reservoir 50, and out of the second air vent in the reservoir 50, into the fire-protected environment. Such unrestricted water flow may cause significant damage, amounting to flooding if not detected and arrested.

According to embodiments of the present invention, the shut-off valve 40, such as an electrically-actuated solenoid or mechanically-actuated valve, is interposed in the fluid flow path upstream of the first air vent valve 44. The shut-off valve 40 is actuated in response to a level of water or other fluid collected in the reservoir 50. In one embodiment, a fluid level sensor in the reservoir 50 is operative to detect fluid at or above a predetermined level. The level sensor may comprise a float switch, a resistive switch, an optical or ultrasonic detector, or the like. The predetermined fluid level is preferably higher than any amount of water that could reasonably be expected to pass the first air vent valve 44, and one-way valve 48, when water first hits the dual air vent assembly 22. In this case, water exceeding the predetermined fluid level is most likely caused by a partial or total failure of the first air vent valve 44.

To prevent this water from being discharged through the second air vent into the fire-protected environment, in one embodiment the fluid level sensor outputs a signal indicating detection of the fluid at or above the predetermined level to control electronics, disposed for example in the control electronics enclosure 36 (although the control electronics may be located elsewhere in other embodiments). The control electronics enclosure 36 includes control electronics, such as a circuit board, operative to receive the signal from the level sensor. In response, the control electronics is further operative to output a control signal to close the shut-off valve 40, which in this embodiment is an electronically-actuated valve, such as a solenoid. Closing the shut-off valve 40 arrests all flow of water from the pipe 16 to the first air vent valve 44, preventing any further water flow into the reservoir 50. The control electronics is also operative, in one embodiment, to trigger an alarm, such as an audible alarm, a visible indicator on the control electronics enclosure 36 such as an LED, a wireless communication, or the like.

In another embodiment, a float mechanism in the reservoir 50 moves when water accumulates in the reservoir 50 at or above a predetermined level. The float mechanism is connected via mechanical linkage (not shown) to the shut-off valve 40, which in this embodiment is mechanically actuated. In this embodiment, the control electronics enclosure 36 may be omitted.

In either embodiment, although actuation of the shut-off valve 40 terminates the flow of water through the failed first air vent valve 44, and hence prevents the discharge of water through the reservoir 50 into the fire-protected environment, the wet pipe fire protection sprinkler system 10 remains in a fully operational standby state, and provides ongoing fire protection. That is, nothing about the detection of excess fluid in the reservoir 50 or arresting the flow of water to the first air vent valve 44 in any way affects the ability of the wet pipe fire protection sprinkler system 10 to discharge water through sprinkler heads 18 that are activated by heat or fire.

Detailed operation of the dual air vent assembly 22 is described with reference to FIGS. 3A-3D, which are section drawings with air/gas and water flow indicators.

Figure 3A:
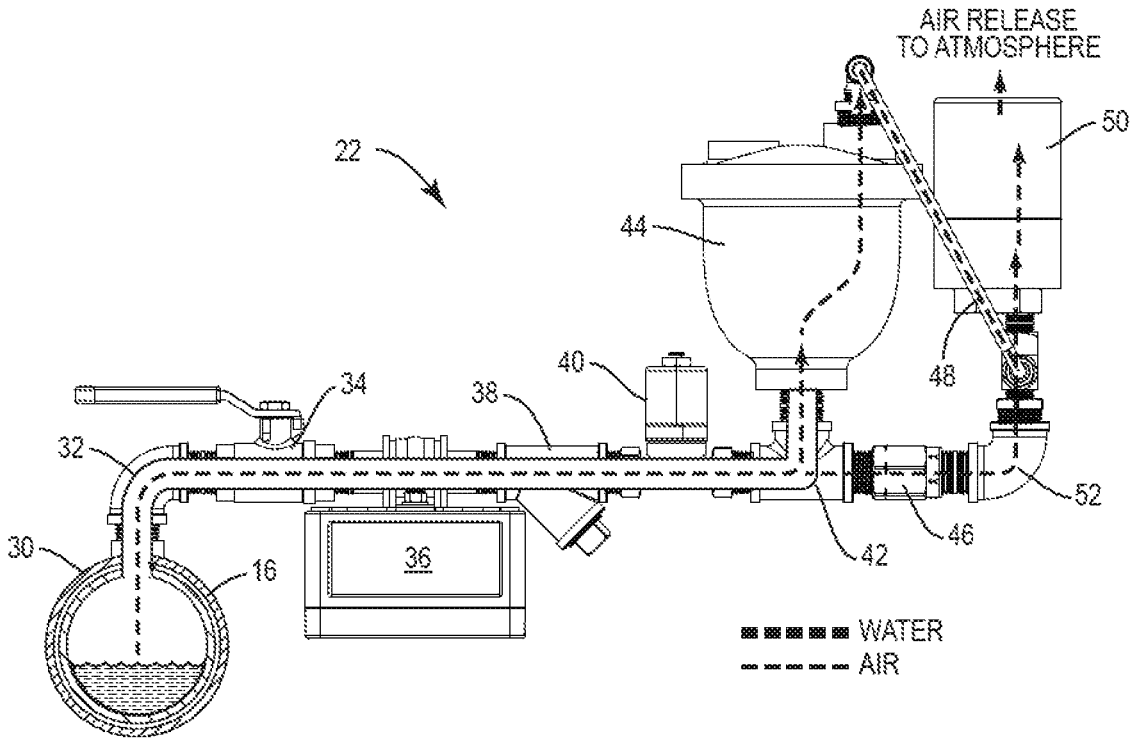
FIGS. 3A-3D are section views of the dual air vent at different stages in filling/draining the pipe.

FIG. 3A depicts the flow of air or other gas from the pipe 16 as it is displaced by water filling the pipe 16. The air or gas flows through the top opening of the pipe 16 and into the dual air vent assembly 22—through the first elbow fitting 32, the manual valve 34, the filter trap 38, the shut-off valve 40 (which is open), and the "T" fitting 42, into the first air vent valve 44. In some embodiments, all of the air or gas is diverted into the first air vent valve 44 by the one-way valve 46, which only allows fluid flow in the direction towards the pipe 16. The air or gas flowing into the first air vent valve 44, rather than being discharged to the atmosphere, flows through the fluid connector 48 and into the reservoir 50. In some embodiments, the one-way valve 46 is implemented as a check valve that arrests the flow of water, but allows air or gas to pass; in these embodiments, some of the air or gas may flow directly into the reservoir 50 through the one-way valve 46, by-passing the first air vent valve 44. In either case, air or gas in the reservoir (whether routed through the first air vent valve 44 via the fluid connector 48 or directly through the one-way valve 46), is discharged from the reservoir 50 through a second air vent.

Figure 3B:
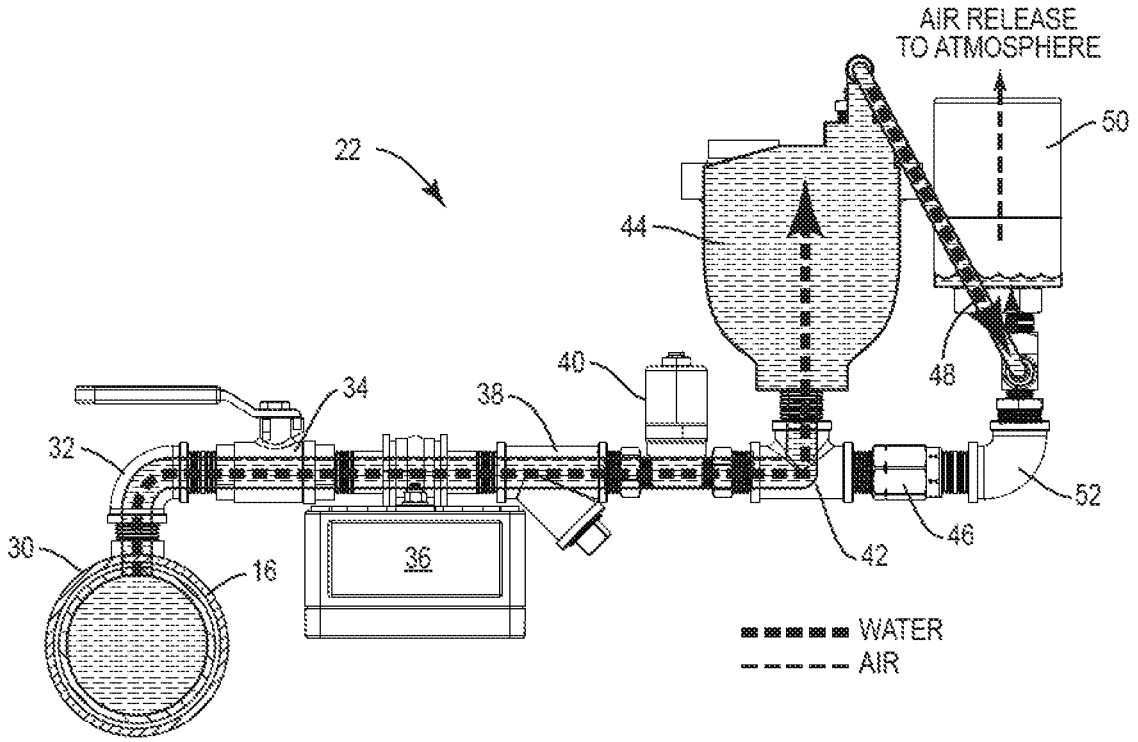

FIG. 3B depicts the operation of the dual air vent assembly 22 when the pipe 16 and the first air vent valve 44 are full of water. After all air or gas has been displaced from the pipe 16, water flows through the first elbow fitting 32, the manual valve 34, the filter trap 38, the shut-off valve 40 (which is open), and the "T" fitting 42, into the first air vent valve 44. Water cannot flow into the reservoir 50 due to the one-way valve 46, which for example may comprise a check valve operative to allow air or gas to pass but to prevent any water flow (other than perhaps an initial small amount). Substantially all the water entering the dual air vent assembly 22 is thus diverted through the "T" fitting 42 and into the first air vent valve 44. A float switch, poppet, check valve, membrane, or similar mechanism in the first air vent valve 44 allows air or gas to exit into the fluid connector 48, but substantially prevents the flow of water out of the first air vent valve 44—other than perhaps an initial small amount. Any small amounts of water discharged by the first air vent valve 44 (or the one-way valve 46) collect in the reservoir 50, where they will evaporate. At this point, the dual air vent assembly 22 has accomplished its purpose of facilitating the discharge of air or gas displaced from the pipe 16 by water, without allowing any water to spill into the fire-protected environment. The dual air vent assembly 22—from the first elbow fitting 32 to the first air vent valve 44—is filled with water at or above the set point pressure of the wet pipe fire protection sprinkler system 10.

Figure 3C:
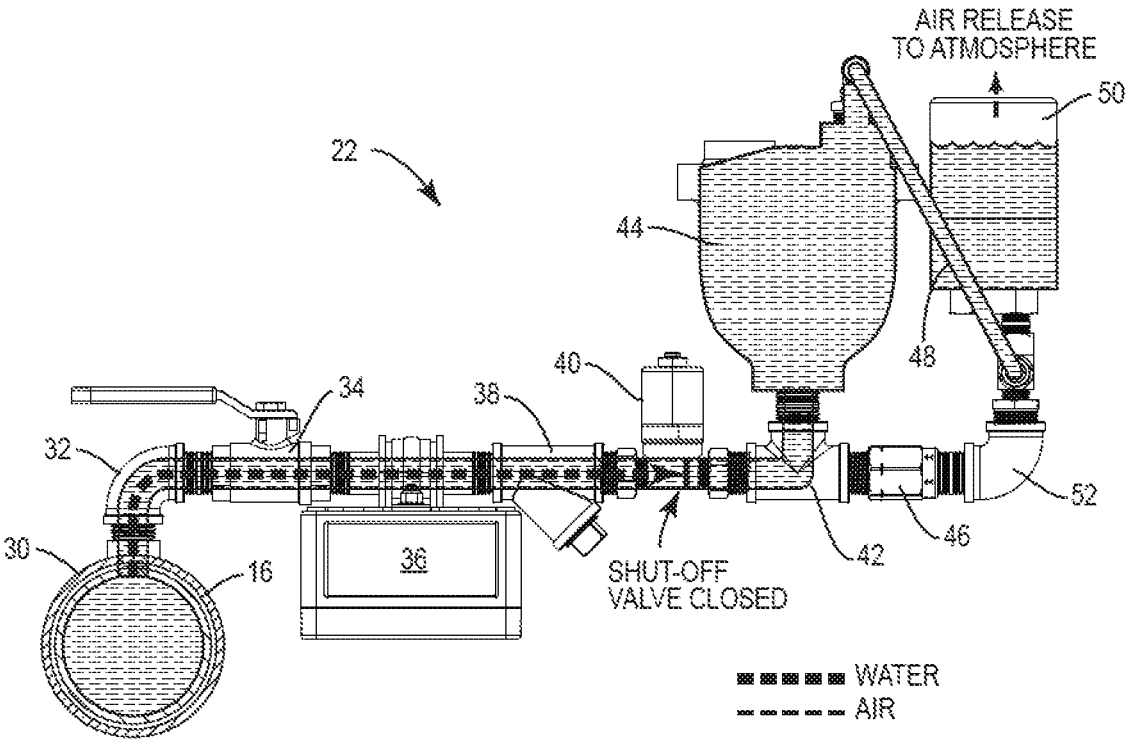

Although the probability of failure of the first air vent valve 44 is very low, it is not zero. FIG. 3C depicts the dual air vent assembly 22 in the event that the first air vent valve 44 does in fact fail, allowing water to escape. The water passes through the fluid connector 48 and into the reservoir 50. In one embodiment, the reservoir 50 includes a fluid level sensor operative to generate an output signal when fluid in the reservoir 50 is at or above a predetermined level. When water from the failed first air vent valve 44 reaches the predetermined level, the fluid level sensor sends an output signal to control electronics. In one embodiment, the control electronics are housed in the control electronics enclosure 36. This enclosure 36 includes circuitry, e.g., located on a printed circuit board, which is operative to receive the output from the fluid level sensor and in response, generate a control signal operative to close the shut-off valve 40. In one embodiment, the shut-off valve 40 comprises an electrical solenoid valve, which is normally open, but which closes upon the application of a control signal. In another embodiment, a float mechanism in the reservoir 50 moves when fluid in the reservoir 50 is at or above a predetermined level. The float mechanism is coupled to the shut-off valve by a mechanical linkage (not shown), and movement of the float mechanism in the reservoir 50 is operative to close the shut-off valve 40 via the mechanical linkage.

In either embodiment, once the shut-off valve 40 is closed, the dual air vent assembly 22 is maintained in the state depicted in FIG. 3C: water from the pipe 16 fills the first elbow fitting 32, the manual valve 34, the filter trap 38, and is stopped at the shut-off valve 40. This water is under the system 10 internal set point pressure. The "T" fitting 42, first air vent valve 44, and fluid connector 48 are filled with (unpressurized) water.

The reservoir 50 is only partially filled with water (i.e., at or above the predetermined fluid level), because closing the shut-off valve 40 arrested any further flow of water into the failed first air vent valve 44. Those of skill in the art will readily understand that, for a given system, the reservoir 50 should be sized such that any initial, transient leakage past the first air vent valve 44 (and one-way valve 46), as water initially floods the dual air vent assembly 22, is well below the predetermined level which will cause the shut-off valve 40 to close. Additionally, the reservoir 50 should be of sufficient volume to hold all water flowing into it from a failed first air vent valve 44 between the time the fluid level passes the predetermined level until the shut-off valve 40 actuates, shutting off the further flow of water.

In one embodiment, the control electronics enclosure 36 includes a rechargeable or replaceable battery, a printed circuit board containing control electronics, an LED or other visible indicator visible through a window or sight glass, and a reset button, switch, or similar input. In this embodiment, the control electronics are operative to receive a signal output by a fluid level sensor in the reservoir 50. In response to the fluid level sensor output, the control electronics are operative to generate a control signal closing the shut-off valve 40 (which in this embodiment is electronically actuated) and generating an indicator, such as illuminating an LED, sounding an audible alarm, or the like. In one embodiment, the control electronics connects to at least the fluid level sensor and shut-off valve 40 by wires. In another embodiment, one or both signal paths are wireless. In one embodiment, in addition to, or in lieu of, generating a visible or audible alarm upon failure of the first air vent valve 44, the control electronics are operative to transmit a signal or message to a remote controller, such as a building-wide fire alarm system, a facilities management program, or the like. This transmission may be via wired or wireless carrier. In one embodiment, a reset button on or extending to the exterior of the control electronics enclosure 36 is operative to reset the control electronics after the faulty first air vent valve 44 has been repaired or replaced. Upon receiving the reset, the control electronics is operative to open the shut-off valve 40, terminate any ongoing alarm, and again monitor the fluid level sensor output. In embodiments where the shut-off valve is mechanically actuated and linked to a float mechanism in the reservoir 50, the control electronics enclosure 36 may be omitted.

Figure 3D:
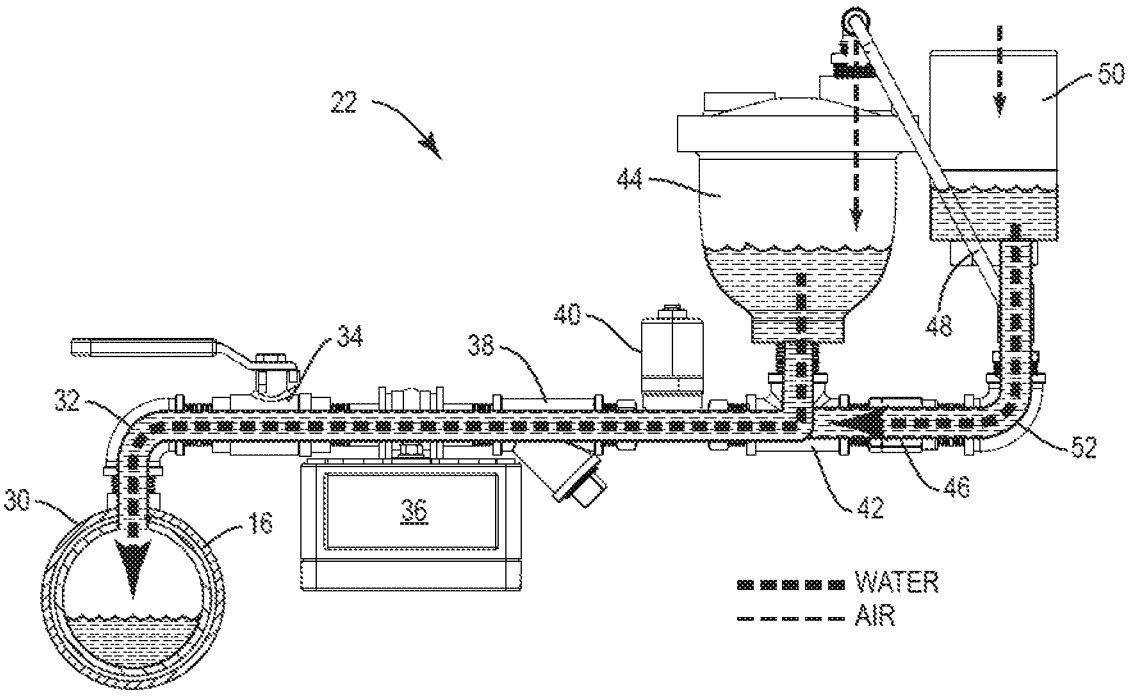

FIG. 3D depicts the dual air vent assembly 22 when the wet pipe fire protection sprinkler system 10 is being drained, which may occur after a failure of the first air vent valve 44, to allow for replacement. Water receding from the pipe 16 will draw the water, and then air, through the dual air vent assembly 22 and into the pipe 16. Additionally, because it is at a high point, water will flow from the dual air vent assembly 22 into the pipe 16 by gravity. The shut-off valve is opened, allowing water to flow from the first air vent valve 44 into the pipe 16. The one-way valve 46 allows water collected in the reservoir 50 to flow, through the second elbow fitting 52, back into the pipe 16.

Figure 4:
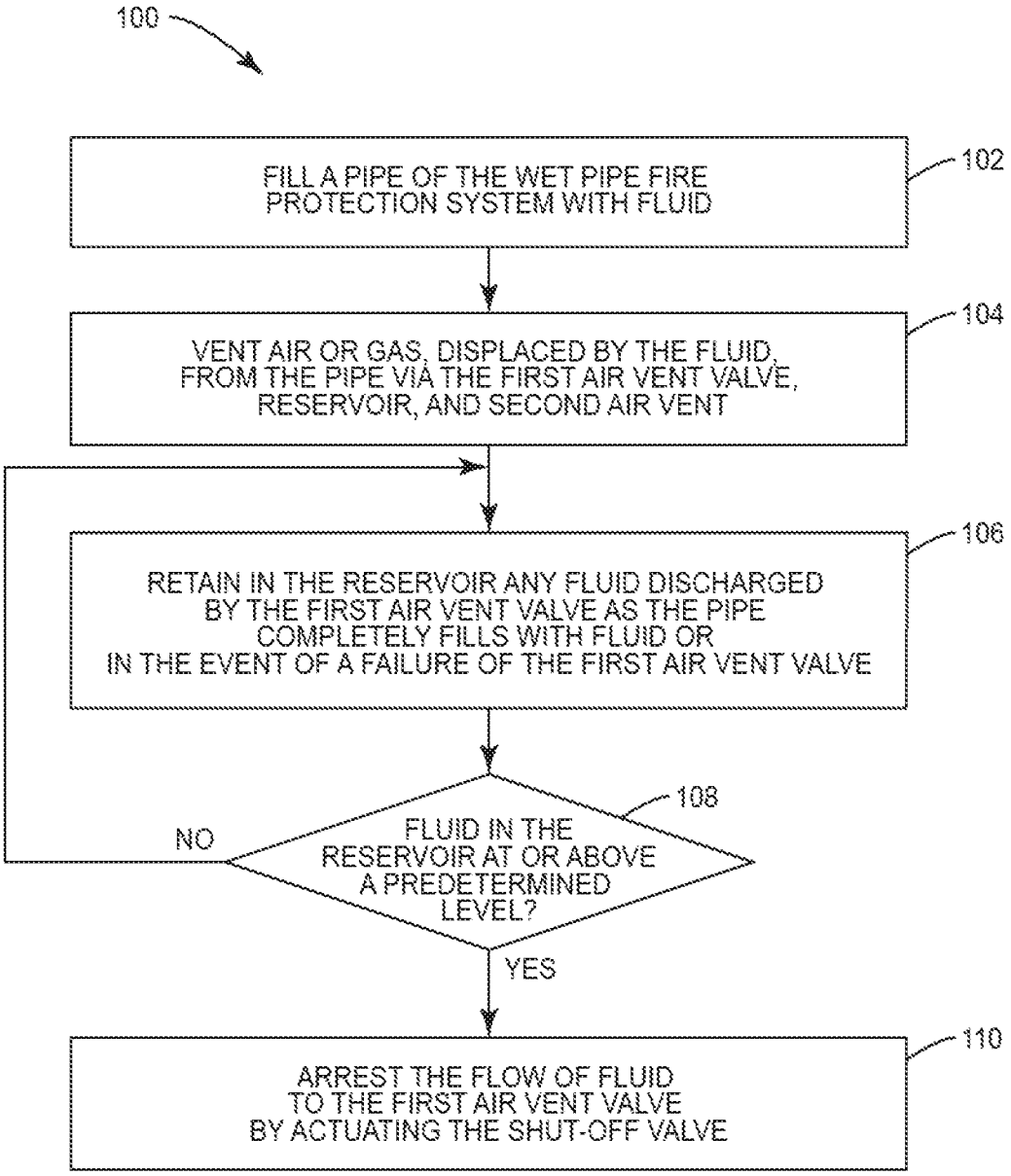
FIG. 4 is a flow diagram of a method of operating a wet pipe fire protection system.

FIG. 4 depicts a method 100 of operating a wet pipe fire protection sprinkler system 10 including at least one dual air vent assembly 22. As described above, the dual air vent assembly 22 comprises a first air vent valve 44 connected to a pipe 16 of the sprinkler system 10 and operative to vent air or gas but substantially no water from the pipe 16, a shut-off valve 40 interposed between the pipe 16 and the first air vent valve 44, a reservoir 50 including a second air vent connected to an output of the first air vent valve 44 in fluid flow relationship, and a fluid level sensor in the reservoir 50 operative to sense fluid at or above a predetermined level.

According to the method 100, a pipe 16 of the wet pipe fire protection system 10 is filled with water (block 102). Air or gas displaced by the water is vented from the pipe 16 via the first air vent valve 44, reservoir 50, and second air vent (block 104). Any water discharged by the first air vent valve 44 as the pipe 16 completely fills with water, or in the event of a failure of the first air vent valve 44, is retained in the reservoir 50 (block 106). If a fluid level in the reservoir 50 is at or above a predetermined level (block 108), then the flow of water from the pipe 16 to the first air vent valve 44 is arrested by actuating the shut-off valve 40 (block 110). If fluid in the reservoir 50 does not rise to the predetermined level (block 108), then the reservoir continues to provide a back-up holding capacity for water should the first air vent valve 44 fail (block 106).

In the above description, reference has been made to air or other gas vented from the pipe 16. Corrosion is a known problem in all types of fire protection sprinkler systems. In wet pipe systems 10, after all of the pipes 12, 16, 17 are filled with water, small pockets of air inevitably remain. This air includes oxygen, which will support oxidation—that is, rust—of the pipes 12, 16, 17. The oxygen also enables aerobic microscopic organisms to live in the water or at the air/water interface; these organisms give off waste products that cause or accelerate corrosion (known as Microbiologically Influenced Corrosion, or MIC). One known approach to inhibiting corrosion in wet pipe systems 10 is to displace atmospheric air in the pipes 12, 16, 17 with nitrogen gas prior to filling the pipes 12, 16, 17 with water. In this case, after the pipes 12, 16, 17 are filled with water, small pockets of gas will still remain; however, they will contain only inert nitrogen gas, and no oxygen. Hence neither rust nor MIC can occur. The dual air vent assembly 22 according to embodiments of the present invention is operative to allow either air or nitrogen gas to exit the pipes 16 as they are filled with water, and to shut off the flow of water in the event of a failure of the first air vent valve 44, without the collateral release of any water into the fire-protected premises.

Even in wet pipe systems 10 that do a nitrogen gas purge of the pipes 12, 16, 17 prior to filling them with water, oxygen may still be present in the system 10. Water usually contains dissolved oxygen—that is, O2 molecules, apart from the oxygen bound up in the H2O molecules forming the water itself. As one example, a test of local city water at 60 degrees F. in Charlotte, N.C. revealed an O2 content of 9.617 ppm (parts per million). Due to the partial pressure of gases, O2 from such water will outgas into the pockets of N2 within the pipes 12, 16, 17, providing enough O2 for the onset of detrimental corrosion. Accordingly, simply purging wet FPS pipes with N2 prior to charging the system may not provide an adequate long-term solution to corrosion.

Deoxygenating water—the process of reducing the number of free oxygen molecules dissolved in water—prior to charging a wet fire protection sprinkler system 10 is known. Water may be deoxygenated by exposure to low-O2-concentration gas and/or vacuum conditions to draw O2 and other residual free gasses out of the water, causing the dissolved O2 to "outgas" into the lower-concentration gas or vacuum. It is known to use N2 gas to deoxygenate water for wet fire protection sprinkler systems. For example, U.S. Pat. No. 9,526,933 discloses a wet fire protection sprinkler system having a water reuse tank and in-line static mixer. The reuse tank is filled with sufficient fresh water to fill the fire protection sprinkler system pipe volume. This water is circulated from the tank through the in-line static mixer, with N2 gas being injected in the circulation line from an N2 generator. The water is circulated through the in-line static mixer until a desired level of deoxygenation is achieved, such as approximately 0.1 ppm (parts per million) of O2. As another example, U.S. Pat. No. 9,616,262, incorporated herein by reference in its entirety, discloses the use of a Gas Transfer Membrane (GTM) device to dynamically deoxygenate water as it flows from a source, such as city water, into the fire protection sprinkler system pipes 12, 16, 17. For example, the water may be deoxygenated to 500 ppb (parts per billion) O2 or less. The dual air vent assembly 22 according to embodiments of the present invention is operative to allow air or gas to exit a pipe 16, and to shut off the flow of water in the event of a failure of the first air vent valve 44, while preventing the spillage of either untreated or deoxygenated water. In general, the wet pipe fire protection system piping may be filled with any fire-retarding or fire-extinguishing fluid—water and deoxygenated water are used in the description herein, but embodiments of the invention are not limited to any form of water.

Embodiments of the present invention simultaneously cure multiple deficiencies in the prior art. The check valve, float valve, or the like in most air vent valves prevent the open flow of water, but will discharge small amounts of water during actuation. According to embodiments of the present invention, this water is collected in a reservoir, and does not spill into the fire-protected environment. If the air vent valve fails, which could result in catastrophic flooding of water from the sprinkler system, embodiments of the present invention shut off the flow of water, and collect what water does escape in the reservoir. When the system is next drained, this water flows back into the system pipes. Thus, the fire-protected environment is completely protected against the discharge of water, either during normal filling or in the event of a component failure.

The present invention may, of course, be carried out in other ways than those specifically set forth herein without departing from essential characteristics of the invention. The present embodiments are to be considered in all respects as illustrative and not restrictive, and all changes coming within the meaning and equivalency range of the appended claims are intended to be embraced therein.

What is claimed is:

1. A dual air vent assembly with a failsafe feature operative to vent air or gas, but not liquid, from a wet pipe fire protection sprinkler system, comprising: an upstream air vent valve connected to a pipe of a sprinkler system, the upstream air vent valve including a liquid blocking mechanism operative to vent air or gas but substantially no liquid from the pipe to an output, wherein the upstream air vent valve is the first air vent valve encountered by a liquid exiting the sprinkler system pipe;

a mechanically or electrically actuated liquid shut-off valve interposed between the pipe and the upstream air vent valve, the mechanically or electrically actuated liquid shut-off valve operative to arrest a flow of the liquid from the pipe to the upstream air vent valve when actuated; and a reservoir including a downstream air vent connected in fluid flow relationship to the output of the upstream air vent valve such that the air or gas, and any of the liquid discharged by the upstream air vent valve, enters the reservoir, wherein the air or gas is discharged from the reservoir through the downstream air vent; wherein the mechanically or electrically actuated shut-off valve is automatically actuated, so as to arrest a further flow of the liquid from the pipe to the upstream air vent valve, in response to the liquid in the reservoir at or above a predetermined level greater than zero.

2. The dual air vent assembly of claim 1 wherein the reservoir is additionally connected to the pipe of the sprinkler system, and further comprising: a one-way valve interposed between the reservoir and the pipe, the one-way valve operative to allow the liquid to flow from the reservoir to the pipe, but prohibit the liquid flow from the pipe to the reservoir.

3. The dual air vent assembly of claim 2 wherein the one-way valve is downstream of the connection of the upstream air vent valve to the pipe.

4. The dual air vent assembly of claim 1 wherein the assembly is connected to the pipe at a top of the pipe.

5. The dual air vent assembly of claim 1 wherein an input to the reservoir is disposed below the output of the upstream air vent valve such that the liquid flows from the upstream air vent valve to the reservoir by gravity.

6. The dual air vent assembly of claim 1 wherein a manual valve is interposed between the pipe and the upstream air vent valve.

7. The dual air vent assembly of claim 1 wherein a filter trap is interposed between the pipe and the upstream air vent valve.

8. The dual air vent assembly of claim 1 wherein the air or gas discharged by the upstream air vent valve is nitrogen gas.

9. The dual air vent assembly of claim 1 wherein the liquid filling the pipe is deoxygenated water having an O2 concentration of 500 ppb or less.

10. The dual air vent assembly of claim 1 further comprising: a liquid level sensor in the reservoir operative to output a signal when the liquid in the reservoir is at or above predetermined level; and control electronics adapted to receive the liquid level sensor signal and to output a control signal to the liquid shut-off valve in response to the liquid level sensor signal; wherein the liquid shut-off valve is electronically actuated by the control signal.

11. The dual air vent assembly of claim 10 wherein the liquid shut-off valve comprises a solenoid.

12. The dual air vent assembly of claim 10 wherein the control electronics are further adapted to output an alarm in the event of actuating the liquid shut-off valve.

13. The dual air vent assembly of claim 1 further comprising: a float mechanism in the reservoir; and a mechanical linkage between the float mechanism and the liquid shut-off valve; wherein the float mechanism is operative to actuate the linkage when the liquid in the reservoir is at or above the predetermined level; and wherein the liquid shut-off valve is mechanically actuated by the linkage.

14. A method of operating a wet pipe fire protection system including at least one dual air vent assembly comprising an upstream air vent valve, including a liquid blocking mechanism, connected to a pipe of a sprinkler system and operative to vent air or gas but substantially no liquid from the pipe, wherein the upstream air vent valve is the first air vent valve encountered by a liquid exiting the sprinkler system pipe, a mechanically or electrically actuated liquid shut-off valve interposed between the pipe and the upstream air vent valve, a reservoir including a downstream air vent connected to an output of the upstream air vent valve in fluid flow relationship, and a liquid level sensor in the reservoir operative to sense liquid at or above a predetermined level, the method comprising:

filling a pipe of the wet pipe fire protection system with a liquid;

venting air or gas, displaced by the liquid, from the pipe via the upstream air vent valve, reservoir, and downstream air vent;

retaining in the reservoir any of the liquid discharged by the upstream air vent valve as the pipe completely fills with the liquid, or in the event of a failure of the upstream air vent valve;

in response to the liquid in the reservoir at or above a predetermined level greater than zero, arresting the flow of the liquid to the upstream air vent valve by automatically actuating the mechanically or electrically actuated liquid shut-off valve.

15. The method of claim 14 wherein actuating the liquid shut-off valve comprises electronically actuating the liquid shut-off valve in response to a signal received from a liquid level sensor disposed in the reservoir.

16. The method of claim 15 further comprising triggering an alarm in response to receiving the output signal of the liquid level sensor.

17. The method of claim 14 wherein actuating the liquid shut-off valve comprises automatically mechanically actuating the liquid shut-off valve in response to movement of a float mechanism disposed in the reservoir.

18. The method of claim 14 further comprising, prior to filling the pipe with the fluid, injecting nitrogen gas into the pipe and venting air displaced by the nitrogen gas via the upstream air vent valve, reservoir, and downstream air vent.

19. The method of claim 14 wherein the liquid is water and further comprising, prior to filling the pipe with the water, deoxygenating the water to an O2 concentration of 500 ppb or less.

20. The method of claim 19 wherein deoxygenating the water comprises interposing a Gas Transfer Membrane (GTM) deoxygenating device between a building water supply and the wet pipe fire protection system pipes, and supplying nitrogen gas to the GTM device.

* * * * *